US005328175A

United States Patent [19]

Yamada

[11] Patent Number: 5,328,175

[45] Date of Patent: Jul. 12, 1994

[54] GOLD CLUB HEAD

[75] Inventor: Magoichi Yamada, Tokyo, Japan

[73] Assignee: Daiwa Golf Co., Ltd., Tokyo, Japan

[21] Appl. No.: 47,282

[22] Filed: Apr. 19, 1993

[30] Foreign Application Priority Data

Apr. 27, 1992 [JP] Japan ..... 4-27586

[51] Int. Cl.[5] ..... A63B 53/04

[52] U.S. Cl. ..... 273/167 H; 273/78

[58] Field of Search ..... 273/167 R, 77 A, 193 R, 273/194 R, 162 R, 77 R

[56] References Cited

U.S. PATENT DOCUMENTS

| | | | |
|---|---|---|---|
| 3,387,844 | 6/1968 | Shippee | 273/78 X |
| 3,817,522 | 6/1974 | Simmons | 273/78 |
| 3,989,248 | 11/1976 | Campau | 273/78 |
| 4,113,249 | 9/1978 | Beery | 273/78 |
| 4,149,726 | 4/1979 | Tredway | 273/78 X |
| 4,214,754 | 7/1980 | Zebelean | 273/167 F X |
| 4,618,149 | 10/1986 | Maxel | 273/167 H X |
| 5,064,197 | 11/1991 | Eddy | 273/78 X |
| 5,178,392 | 1/1993 | Santioni | 273/167 H |

FOREIGN PATENT DOCUMENTS

| | | | |
|---|---|---|---|
| 124401 | 1/1947 | Australia | 273/167 H |
| 3531514 | 2/1953 | Japan . | |
| 49-50063 | 5/1974 | Japan . | |

*Primary Examiner*—V. Millin
*Assistant Examiner*—Sebastiano Passaniti
*Attorney, Agent, or Firm*—Longacre & White

[57] ABSTRACT

A golf club head made of a metallic material includes a projection which is rearwardly projected away from a face portion of a main body while forming a cavity having the substantially same interior configuration as the exterior configuration of the projection. A face member molded of a synthetic resin and having a fully closed air chamber formed therein is securely fitted into the cavity using an adhesive. A ball hitting surface of the face member is flush with the surface of the face portion. A thickness of the face member between the ball hitting surface and the air chamber is larger than a thickness of the same on the back portion side about three times.

11 Claims, 2 Drawing Sheets

GOLD CLUB HEAD

BACKGROUND OF THE INVENTION

1. Field of the Invention

The present invention relates generally to a golf club head made of a metallic material, and in particular, to a golf club head of the foregoing type durable against shock upon hitting a golf ball and capable of driving a golf ball further.

2. Description of the Related Art

So-called iron club head is generally made of a metallic material such as soft steel, stainless steel or the like so that hosel, sole and face portions thereof are integrated with each other.

As is well known, each of golf club heads of the foregoing type is made with a different configuration and a different weight corresponding to a given club head number. However, because of mass of metallic material, the golf club head lacks elasticity. Especially, when a face portion of the golf club head, i.e., a most important portion of the same for hitting a golf ball has few elasticity, it exhibits a small value of repulsive coefficient. In addition, with the iron club head, a golf player can not enjoy soft hit feeling attainable when he hits a golf ball with a wood club.

To assure that a golf player can enjoy soft hit feeling also with an iron club head, a proposal is already made with respect to a golf club head as disclosed in Japanese Utility Model Publication No. 35-31514 wherein a face plate molded of a synthetic resin is secured to a face portion of the golf club head by tightening screws.

As shown in FIG. 4, according to this prior invention, a face plate 9 molded of a synthetic resin and having a concave recess 7 formed on the rear surface side is detachably secured to a recessed part 5*a* of a face portion 3 of a main body 1 by tightening screws 11.

With this construction, since the face plate 9 has a reduced thickness in the hitting range attributable to the formation of the concave recess 7 on the rear surface side, and moreover, a gap 13 is formed between the concave recess 7 of the face plate 9 and a bottom surface 5*a* of the recessed part 5, it can be expected that a certain magnitude of repulsive force is generated by elastic deformation of the face plate 9.

It is certain that the repulsive force is generated to some extent with the face plate 9 having the concave recess 7 formed on the rear surface side in that way. However, there arises a problem that the strength of the face plate 9 is degraded due to reduction of the thickness of the face plate 9 in the hitting range. In addition, since the gap 13 is not formed in the hermetically closed state, the air remaining in the gap 13 does not exhibit a cushioning function for attenuating the stress appearing on the hitting surface of the face plate 9. Thus, there is a possibility that the face plate 7 is broken as the golf club head is repeatedly used for a long time.

Further, a proposal is made with respect to a wood club head as disclosed in Japanese Utility Model Laid-Open Publication NO. 49-50063 although this is not concerned with the iron club head. As shown in FIG. 5, according to this prior invention, the wood club head is constructed such that a tip 17 made of cemented tungsten carbide or titanium carbide is fitted into the central part of a hitting range on a face plate 15 molded of a synthetic resin of which rear surface is recessed, and the face plate 15 is then fitted into a recessed part 23 of a face portion 21 of a main body 19.

With this construction, it can be expected that a certain magnitude of repulsive force is generated by the face plate 15 attributable to the formation of the recessed part 23 on the rear surface side. However, there is a possibility that the face plate 15 is broken due to repeated shock imparted thereto in the same manner as the iron golf club shown in FIG. 4 as the wood club head is repeatedly used for a long time.

SUMMARY OF THE INVENTION

The present invention has been made in consideration of the foregoing background.

An object of the present invention is to provide a golf club head capable of driving a golf ball further.

Another object of the present invention is to provide a golf club head of the foregoing type which is more durable against shock arising at the time of ball hitting.

The present invention provides a golf club head, made up of a main body made of a first material and formed with a recess; and a face plate made of a second material more elastic than the first material and formed with a closed air-chamber embedded therein, wherein the face plate is securely received in the recess.

When a golf player hits a golf ball with his golf club having the golf club head of the present invention attached thereto, the face plate or face member is slightly deformed, causing the air in the air chamber to be compressed. Thus, a large magnitude of repulsive energy generated by the compression of the air in the air chamber is imparted to the golf ball, resulting in the golf ball flying at a longer distance than that obtainable with the conventional golf club head.

In addition, since the shock arising at the time of ball hitting is dispersively absorbed in the air in the air chamber, the face member, i.e., a significant member of the golf club head is hardly broken after the golf club head is repeatedly used for a long time. This means that the golf club head can be used for a long time. Other objects, features and advantages of the present invention will become apparent from reading of the following description which has been made in conjunction with the following drawings.

BRIEF DESCRIPTION OF THE DRAWINGS

The present invention is illustrated in the following drawings in which.

DESCRIPTION OF THE PREFERRED EMBODIMENT

The present invention will now be described in detail hereinafter with reference to FIG. 1 to FIG. 3 which illustrate a preferred embodiment of the present invention.

Figure 1:
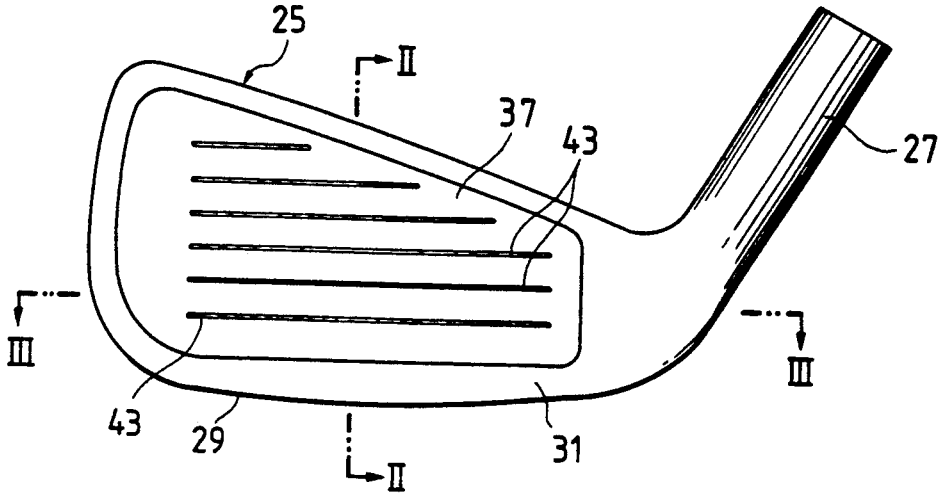
FIG. 1 is a front view of a golf club head constructed according to an embodiment of the present invention.

In FIG. 1, reference numeral 25 designates a main body of a golf club head constructed according to the embodiment of the present invention. The main body 25 is made of metal or fiber reinforced metallic material, and includes a hosel portion 27, a sole portion 29 and a face portion 31 integrated with each other. In addition, as shown in FIG. 2, a back portion 33 is also integrated with the main body 25.

Figure 2:
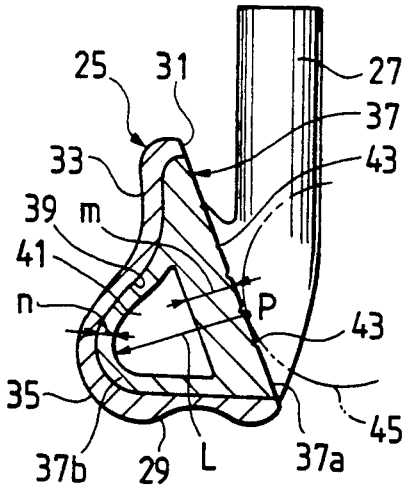
FIG. 2 is a sectional view of the golf club head taken along line II—II in FIG. 1.
Figure 3:
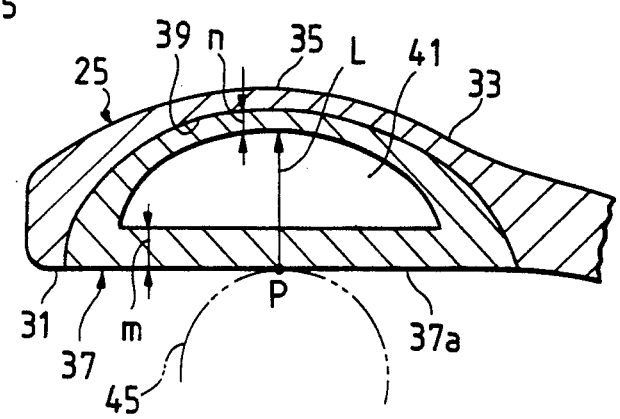
FIG. 3 is a sectional view of the golf club head taken along line III—III in FIG. 1.
Figure 4:
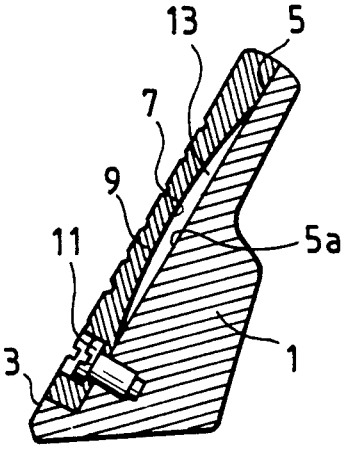
FIG. 4 (PRIOR ART)
FIG. 4 is a sectional view of a conventional golf club head.
Figure 5:
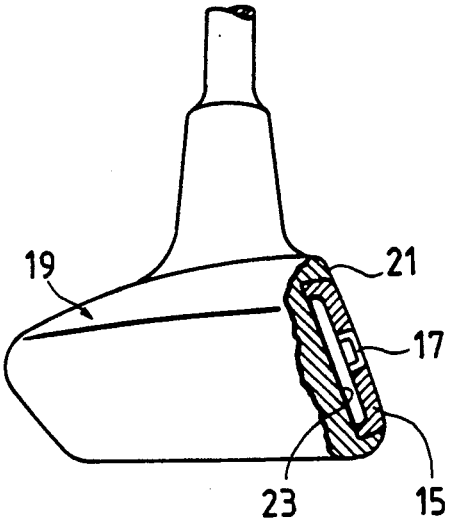
FIG. 5 (PRIOR ART)
FIG. 5 is an exploded perspective view of another conventional golf club head.

As shown in FIG. 2 and FIG. 3, the back portion 33 includes a projection 35 near the sole portion 29, which is rearwardly projected and lies from the heel side to the toe side of the main body 25. The projection 35 is configured such that the rearmost end of a perpendicular line L extending from a sweet spot P on a ball hitting surface 37*a* of a face member 37 (to be described later) is located on a portion of the projection 35 farthest away from the ball hitting surface 37*a*. In other word, a crest of the projection 35 relative to the ball hitting surface 37*a* is located on a perpendicular line L extending from a sweet spot P on a ball hitting surface 37*a*.

A cavity or recess 39 having the substantially same interior configuration as the exterior configuration of the back portion 33 is formed in the projection 35 while it is kept opened at a side where the face portion 31 is located. As is best seen in FIG. 3, the main body 25 has a small thickness on the projection 35 side compared with the heel side and the toe side. The face member 37 is securely fitted into the cavity 39 using an adhesive or the like while it is flush with the face portion 31.

The face member 37 is molded of a synthetic resin containing a fiber reinforced synthetic resin. The face member 37 has a substantially flat portion 37*a* forming a ball hitting surface and a fitted part 37*b* whose exterior configuration is coincident with the interior configuration of the cavity 39. A fully or completely closed air chamber 41 having a relatively large volume is formed in the face member 27. The face member 37 is received in the cavity 39.

As shown in FIG. 2, a part of the air chamber 41 near the back portion 33 is configurated along the curved inner wall surface of the projection 35, while a part of the air chamber 41 near the face portion 31 is configurated substantially in parallel with the ball fitting surface 37*a*. A thickness m of a portion of the face member 37 between the ball hitting surface 37*a* and the air chamber 41 is dimensioned to be larger than a thickness n of a portion of the face member 37 on the back portion 33 about three times. Since the rearmost end of the perpendicular line L extending from the sweet spot P on the face member 37 is located on the portion of the back portion 33 farthest away from the ball hitting surface 37*a* of the face member 37 as mentioned above, each of the face member 37 and the air chamber 41 has a largest width on the perpendicular line L.

Therefore, in the golf club head according to the present invention, the face member 37 containing therein the air chamber 41 is surrounded by the main body 25 with the exception of the ball hitting surface 37*a*.

In FIG. 1, reference numeral 43 designates a plurality of score lines which are formed on the ball hitting surface 37*a* of the face member 37 while extending in parallel with each other, and in FIG. 2 and FIG. 3, reference numeral 45 designates a golf ball.

Since the golf club head is constructed in the above-described manner, when a golf player hits a golf ball 45 with his golf club having the golf club head of the present invention attached thereto, the face member 37 is deformed by the shock arising at the time of ball hitting. At this time, a large magnitude of repulsive energy is imparted to the golf ball 45 based on the repulsive force derived from the compression of the air in the air chamber 41 as well as the elastic deforming force derived from the deformation of the face member 37. In addition, since the face member 37 is surrounded together with the air chamber 41 by the relatively hard main body 25 with the exception of the ball hitting surface 37*a*, the air compression energy given by the golf ball 45 at the time of ball hitting is immediately converted into a repulsive energy which in turn is imparted to the golf ball 45 at a high efficiency.

Consequently, the golf club head constructed according to the embodiment of the present invention makes it possible to drive the golf ball 45 at a longer distance than the conventional golf club head.

It should be noted that the stress induced by the shock at the time of ball hitting is dispersively absorbed in the air in the air chamber 41 by the function of air cushioning.

According to the embodiment of the present invention, since the ball hitting surface 37*a* of the face member 37 is reinforced by dimensioning the thickness m between the air chamber 41 and the ball hitting surface 37*a* to be larger than the thickness n of the face member 37 on the back portion 33 side about three times, this reinforced construction reliably prevents the ball hitting surface 37*a* of the face member 37 from being broken due to the repeated shock arising every time the golf ball 25 is hit with the golf club head.

In addition, according to the embodiment of the present invention, since the face member 37 having the fully closed air chamber 41 formed therein is securely fitted into the main body 25 such that the rearmost end of the perpendicular line L extending from the sweet point P on the face member 37 is located farthest away from the ball hitting surface 37*a*, directionality of flying of the golf ball 25 can be improved compared with the conventional golf club head.

Figure 6:
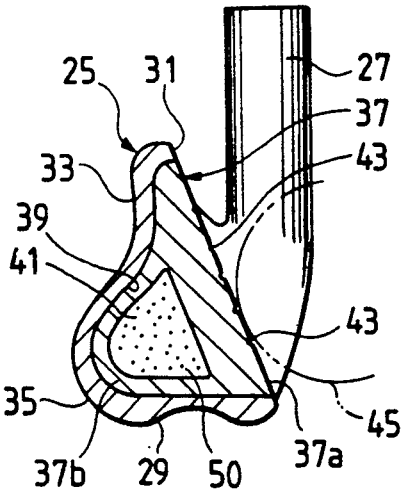
FIG. 6 is a sectional view showing a golf club head according to the present invention, in which an air chamber is filled with foam sythetic resins.

In addition, the air chamber 41 sealingly and embeddingly formed in the face plate 37 may be filled with foam synthetic resins 50 as shown in FIG. 6.

While the present invention has been described above merely with respect to a single preferred embodiment thereof, it should of course be understood that the present invention should not be limited only to this embodiment but various change or modification may be made without departure from the scope of the present invention as defined by the appended claims.

What is claimed is:

1. A golf club head comprising:

a main body made of a first material and formed with a recess, and a face portion defining an open end of said recess; and a face plate made of a second material more elastic than said first material and formed with a closed air-chamber embedded therein, wherein said face plate is securely received in said recess and defines a ball hitting surface, and wherein said face portion circumscribes said ball hitting surface.

2. The golf club head according to claim 1, wherein said first material includes metallic material, and said second material includes resin material.

3. The golf club head according to claim 1, wherein said face plate has a substantially flat surface forming a ball hitting surface when said face plate is securely received in said recess.

4. A gold club head comprising:

a main body made of a first material and formed with a recess; and a face plate made of a second material more elastic than said first material and formed with a closed air-chamber embedded therein, wherein said face plate is securely received in said recess, wherein said main body includes a face portion defining an open end of said recess and a back portion located opposite from said face portion, said back portion having a projection projecting away from said face portion and an inner surface for defining said recess and an outer surface opposite to said inner surface, said inner surface substantially corresponding to said outer surface in configuration.

5. The golf club head according to claim 4, wherein said main body further includes a toe portion and a heel portion connecting lateral ends of said face portion to respective lateral ends of said back portion, and wherein a distance between said outer and inner surfaces of said back portion at a location where said projection is provided is smaller than that at another location where said back portion is connected to said toe portion or said heel portion.

6. The golf club head according to claim 4, wherein said face plate has a substantially flat surface forming a ball hitting surface when said face plate is securely received in said recess.

7. The golf club head according to claim 6, wherein a rear part of said air chamber substantially corresponds in configuration to said inner surface of said back portion and a front part of said air chamber is substantially parallel to said ball hitting surface.

8. The golf club head according to claim 6, wherein a minimum distance between said ball hitting surface and said air chamber is larger than a minimum distance between said air chamber and said inner surface of said back portion.

9. The golf club head according to claim 6, wherein a crest of said projection relative to said ball hitting surface is located on a perpendicular line extending from a sweet spot provided on said ball hitting surface.

10. The golf club head according to claim 3, wherein said ball hitting surface is only exposed from said main body when said face plate is received in said recess.

11. The golf club head according to claim 1, wherein said air-chamber is filled with foam synthetic resins.

* * * * *